US006958023B2

(12) United States Patent
Simo et al.

(10) Patent No.: US 6,958,023 B2
(45) Date of Patent: Oct. 25, 2005

(54) ARROW FLETCHING

(75) Inventors: Miroslav A. Simo, Riverside, IL (US); Robert S. Mizek, Downers Grove, IL (US); Frank A. Harwath, Naperville, IL (US)

(73) Assignee: New Archery Products Corp., Forest Park, IL (US)

( * ) Notice: Subject to any disclaimer, the term of this patent is extended or adjusted under 35 U.S.C. 154(b) by 0 days.

(21) Appl. No.: 10/762,682

(22) Filed: Jan. 20, 2004

(65) Prior Publication Data

US 2005/0159256 A1 Jul. 21, 2005

(51) Int. Cl.[7] ..... F42B 6/06
(52) U.S. Cl. ..... 473/586
(58) Field of Search ..... 473/586, 578

(56) References Cited

U.S. PATENT DOCUMENTS

| | | | |
|---|---|---|---|
| 219,881 | A | 9/1879 | Streeter |
| 2,193,397 | A | 3/1940 | Dykes |
| 2,277,743 | A | 3/1942 | Crossman |
| 2,525,332 | A | 10/1950 | Alger et al. |
| 2,830,818 | A | 4/1958 | Otto |
| 2,887,319 | A | 5/1959 | Lay |
| 2,976,042 | A | 3/1961 | Barnett |
| 3,106,400 | A | 10/1963 | Zwickey |
| 3,539,187 | A | 11/1970 | Smith |
| 3,595,579 | A | 7/1971 | Benolt |
| 3,672,677 | A | 6/1972 | Moore |
| 3,749,403 | A | 7/1973 | Austin et al. |
| 3,756,602 | A | 9/1973 | Carella |
| 3,815,916 | A | 6/1974 | Meszaros |
| D232,356 | S | 8/1974 | Melton |
| 3,897,062 | A | 7/1975 | Christensen |
| 4,003,576 | A | 1/1977 | Carella |
| 4,012,043 | A | 3/1977 | Carella |
| 4,088,323 | A | 5/1978 | Munger |
| 4,204,307 | A | 5/1980 | Pfetzing |
| 4,234,192 | A | 11/1980 | Salamone |
| 4,392,654 | A | 7/1983 | Carella |
| 4,477,084 | A | 10/1984 | Austin |
| 4,488,728 | A | 12/1984 | Humphrey |
| 4,502,692 | A | 3/1985 | Humphrey |
| 4,534,568 | A | 8/1985 | Tone |
| 4,565,377 | A | 1/1986 | Troncoso, Jr. et al. |
| 4,583,745 | A | 4/1986 | Ladner |
| 4,986,550 | A | 1/1991 | Segovia |
| 5,064,202 | A | 11/1991 | Barner |
| 5,213,090 | A | 5/1993 | Tone |
| 5,257,809 | A | 11/1993 | Carrizosa |
| 5,427,385 | A | 6/1995 | Conrad et al. |
| 5,439,231 | A | 8/1995 | Roberts et al. |
| 5,443,273 | A | 8/1995 | Lovorn |

(Continued)

FOREIGN PATENT DOCUMENTS

| | | |
|---|---|---|
| JP | 2003-21499 | 1/2003 |

*Primary Examiner*—John A. Ricci
(74) *Attorney, Agent, or Firm*—Pauley Petersen & Erickson

(57) ABSTRACT

An arrow fletching having a plurality of flexible vanes each having a generally tapered profile extending from a narrow end to a wide end. A kicker is integrated with a perimeter of the wide end of the flexible vane wherein the kicker includes a concave portion extending tangentially from the flexible vane. Additionally, each vane may have a concave side and/or increased surface roughness to create an arrow that travels faster, straighter and/or more accurately.

21 Claims, 3 Drawing Sheets

U.S. PATENT DOCUMENTS 5,465,981 A 11/1995 Klaus
5,613,688 A 3/1997 Carella
5,846,147 A 12/1998 Basik
5,897,449 A 4/1999 Roberts et al.
6,142,896 A 11/2000 Simo et al.
6,203,457 B1 3/2001 Snook
6,319,161 B1 11/2001 Martinez et al.
6,695,727 B1 2/2004 Kuhn

ARROW FLETCHING

BACKGROUND OF THE INVENTION

1. Field of the Invention

This invention relates to an arrow fletching having a concave side effected with an integrated kicker or a bowed foot.

2. Description of Related Art

Conventional archery arrows include fletchings having a vane with two similar opposing surfaces. Such archery vanes do not affect rotation during arrow flight resulting in poor arrow shaft stability and poor arrow flight accuracy.

In an effort to increase rotation of the arrow, conventional vanes are attached to the arrow shaft in a helical or offset orientation with respect to the longitudinal axis of the arrow shaft. The helical or offset orientation of the archery vanes generates more rotation during flight than other conventional archery vanes. However, due to the decreased clearance between archery vanes, the archery vanes interfere with an arrow rest of a bow, for example as the arrow is shot. This interference causes the arrow to change direction as it is shot from the bow or wobble during flight, resulting in decreased accuracy and flight distance. Further, because of a required offset position arrows having helically oriented archery vanes are difficult to manufacture.

There is an apparent need for an archery vane which generates enough rotation of the arrow shaft about a longitudinal axis to provide increased rotation and increased stability to the arrow shaft and improve flight accuracy of the arrow.

It is also apparent that there is a need for an archery vane that can be positioned along the arrow shaft parallel with respect to the longitudinal axis of the arrow shaft, to simplify manufacturing of arrows while providing enhanced aerodynamic flight.

SUMMARY OF THE INVENTION

It is an object of this invention to provide an archery vane having an integrated kicker having a concave portion that extends outwardly from the archery vane.

It is another object of this invention to provide an archery vane having a concave side.

It is yet another object of this invention to provide an archery vane having a generally planar side and bowed foot in a relaxed state and a generally concave side and generally straight foot in a tensioned state.

It is still another object of this invention to provide an archery vane that may be applied to an archery shaft parallel with a longitudinal axis of the archery shaft.

These and other objects of this invention are accomplished with a fletching comprising a plurality of vanes. Such vanes generally comprise a tapered profile bounding a first side and an opposing second side. Each vane further includes a foot integrated across a bottom of the vane. The foot is preferably used to attach the vane to the arrow shaft.

Each vane may further include an integrated kicker attached to at least a portion of the vane. The kicker is preferably formed along an arcuate path and includes a concave portion extending away from the flexible vane, preferably extending tangentially from the vane. The kicker may be molded to the vane in a co-molding process or may be otherwise attached to the vane during or following production of the vane. The kicker may comprise a different, stiffer material from the vane. More preferably, the kicker may be integrated with the vane in such a manner so as to place the vane under tension. As a result of such tension, the vane may be concave along the first side or the second side.

In one preferred embodiment of this invention, the first side and/or the second side are convex, forming an airfoil-type archery vane. In such an embodiment, the first side may have a different surface roughness from the second side, such as a smooth first side and a grooved second side.

Alternatively, or in addition, each vane may include the foot extending along a base of the vane wherein, in a relaxed state, the foot is bowed along a lower edge. As a result of the bowed configuration of the foot, when the foot is straightened, such as by application of the vane to an arrow shaft, the first side (or the second side) of the vane becomes concave.

As a result of such concavity and/or different surface roughness and/or the bowed foot, the fletching according to this invention maybe applied to arrow shaft so that the vane extends parallel with a longitudinal axis of arrow shaft. In addition, the speed, spin and/or accuracy of the arrow may be improved, increased and/or optimized.

BRIEF DESCRIPTION OF THE DRAWINGS

The drawings show different features of an archery fletching and/or vane according to preferred embodiments of this invention, wherein.

DETAILED DESCRIPTION OF THE PREFERRED EMBODIMENTS

Figure 1:
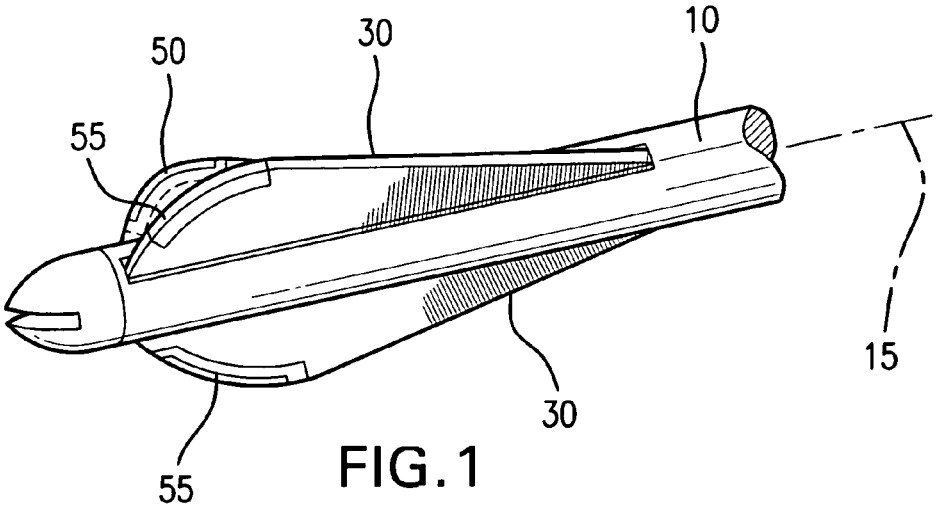
FIG. 1 is a side view of a portion of an arrow fletching having a plurality of archery vanes attached to an arrow shaft, according to one preferred embodiment of this invention.

FIG. 1 shows a portion of an arrow including arrow shaft 10 and fletching 20 comprising a plurality of vanes 30. Preferably, but not necessarily, three or four vanes 30 are positioned on or attached to arrow shaft in a circumferential relation on an outer surface of arrow shaft 10. According to one preferred embodiment of this invention, three vanes 30 are positioned equally about the circumference of arrow shaft, i.e. each vane 30 is positioned 120° from each of the two other vanes 30. It is apparent to one skilled in the art that more or less than three archery vanes 30 can be positioned about or on arrow shaft 10.

In one preferred embodiment of this invention, vanes 30 are positioned about or on arrow shaft 10 generally parallel to a longitudinal axis or spin axis 15 of arrow shaft 10. Vanes 30 may be positioned along arrow shaft 10 in a left or right helical orientation. In such an orientation, vanes 30 are offset with respect to spin axis 15. However, in order to provide maximum clearance between vanes 30 and an arrow rest when the arrow is loaded in a bow, in the preferred embodiments of this invention, vanes 30 are positioned generally parallel to spin axis 15 as shown in FIG. 1. Thus, there is no adverse interference with respect to any other archery component, including the arrow rest, when loading the arrow having the described fletching 20 of this invention within the bow. Further, the arrow having a plurality of vanes 30 mounted on arrow shaft 10 and generally parallel to spin axis 15 is much easier to manufacture than conventional arrows having a plurality of archery vanes positioned in a helical configuration about an arrow shaft.

Figure 2:
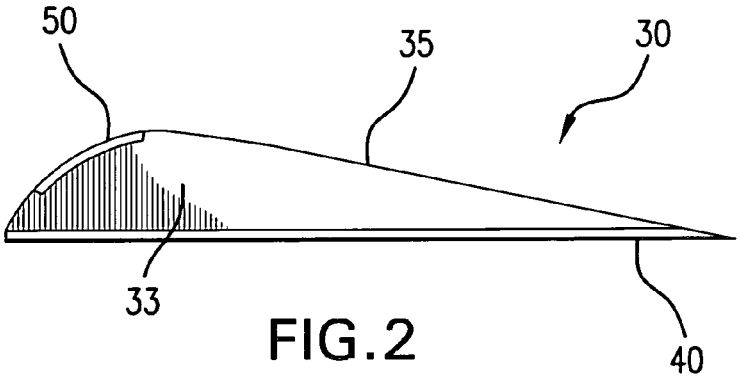
FIG. 2 is a side view of an archery vane according to one preferred embodiment of this invention.
Figure 3:
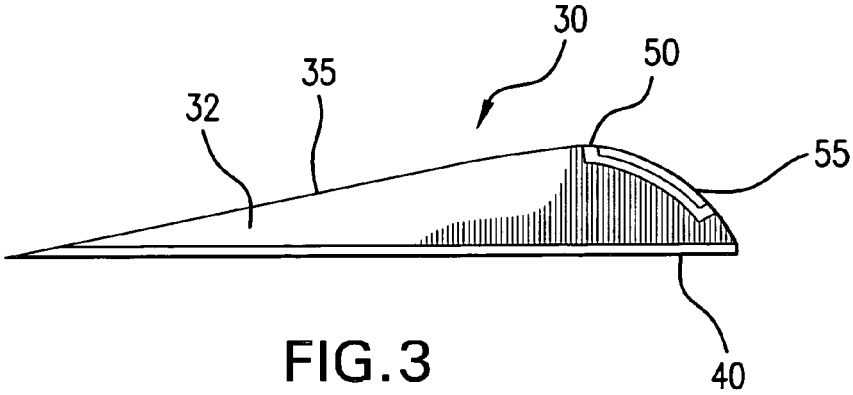
FIG. 3 is an opposite side view of the archery vane shown in FIG. 2.
Figure 4:
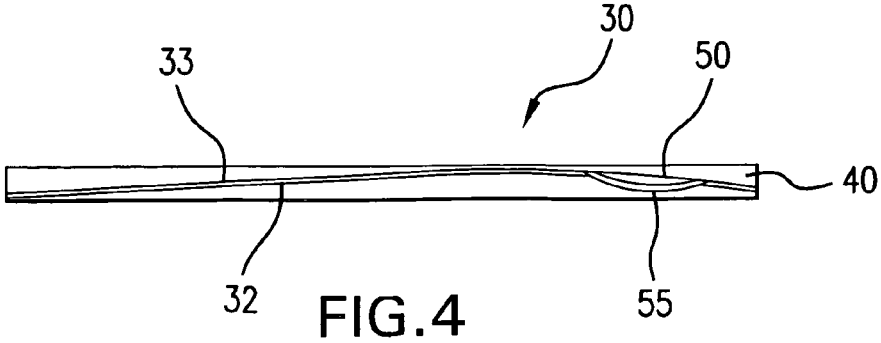
FIG. 4 is a top view of the archery vane shown in FIG. 2.

As best shown in FIGS. 1–3, vane 30 includes a generally tapered profile 35 extending from a leading, narrow end to a trailing, wide end. Vane 30 includes a defined profile 35 as shown in FIG. 2 or can have any other suitable defined profile 35 similar to a shape of any conventional vane that provides acceptable aerodynamic flight characteristics.

Vane 30 further comprises a first side 32 and an opposing second side 33. As shown in FIG. 2, first side 32 and second side 33 are generally mirror image sides having a first surface area and a second surface area, respectively, within the defined profile, i.e. the first surface area is generally equal to the second surface area, with exceptions as further discussed below.

Vane 30 may further include foot 40 integrated across a bottom of vane 30. Foot 40 is preferably used to attach vane 30 to arrow shaft 10 and thus may include a small strip of material placed perpendicularly along a bottom portion of vane 30.

As shown in FIGS. 1–4, kicker 50 may be attached to at least a portion of vane 30. Kicker 50 may be integrated and/or attached to vane 30 during or after manufacture of vane 30. As shown in FIGS. 1–4, kicker 50 may be integrated with a perimeter of the wide end of vane 30.

Kicker 50 is preferably formed along an arcuate path and includes concave portion 55 extending away from the flexible vane. Concave portion 55 preferably extends tangentially from vane 30. Kicker 50 may be positioned flush with the perimeter of vane 30 so as to minimize and/or optimize aerodynamic interference.

Kicker 50 may be molded to vane 30 in a co-molding process or may be otherwise attached to vane 30 during or following production of vane 30. Kicker 50 may or may not comprise the same material as vane 30. In one preferred embodiment of this invention wherein kicker 50 comprises a different material from vane 30, kicker 50 may be formed of a stiffer material than vane 30.

According to one preferred embodiment of this invention, kicker 50 is integrated with vane 30 in such a manner so as to place vane 30 under tension. As a result of such tension, vane 30 may be concave along a first side 32 or second side 33.

Figure 5:
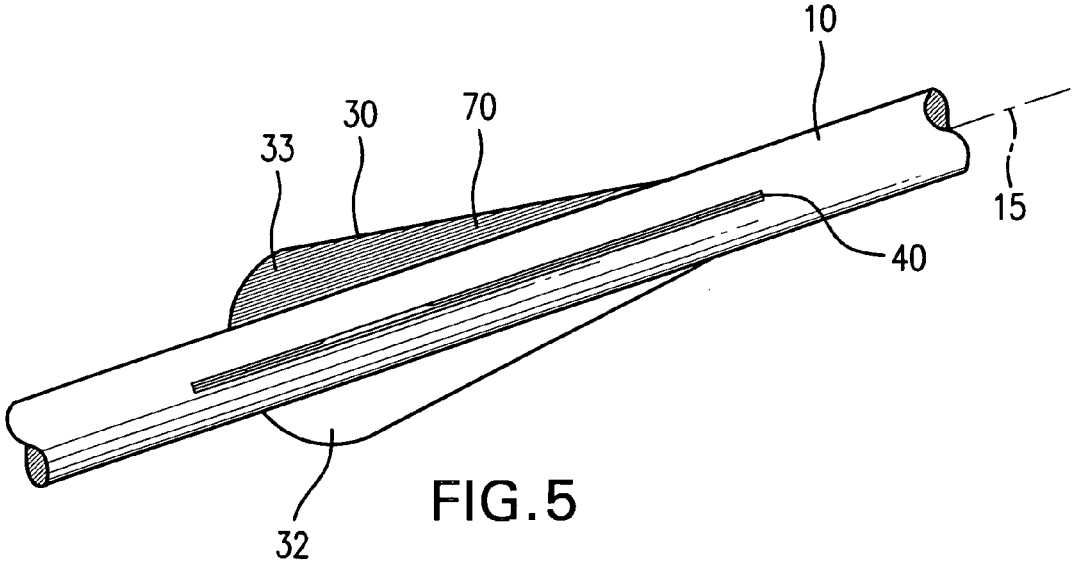
FIG. 5 is a side view of a portion of an arrow fletching having a plurality of archery vanes attached to an arrow shaft, according to one preferred embodiment of this invention.
Figure 6A:
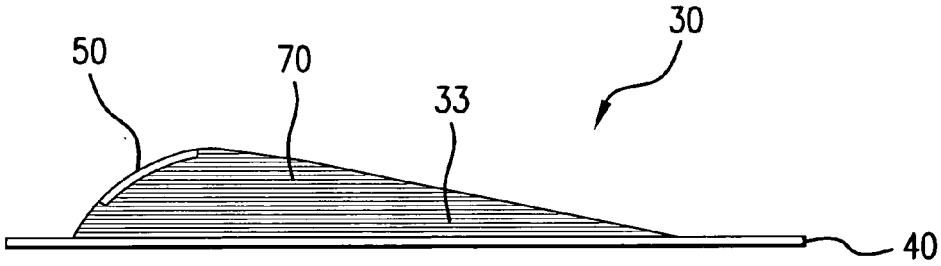
FIG. 6A is a side view of an archery vane having a plurality of microgrooves according to one preferred embodiment of this invention.

In certain preferred embodiments of this invention, vane 30 is produced from an extrusion process forming an I-beam structure or ribbon of vane material, for example about 100 feet to about 200 feet in length, having a generally planar first side 32 and a generally planar second side 33. Alternatively, one of first side 32 or second side 33 may include a roughened surface area. For example, the roughened surface may comprise a plurality of parallel lands and grooves forming microgrooves 70, as shown in FIGS. 5 and 6A.

The ribbon of vane material may include two opposing feet 40. Each opposing foot 40 eventually will form foot 40 of an individual vane 30. The ribbon is then preferably placed in a press and heated to a molten temperature and at least one kicker 50 may be concurrently or subsequently formed in vane 30. The ribbon of vane material may then be cut into individual vanes 30 using means known to those skilled in the art, for example a die. Such extrusion process as described generally allows any variety of vanes 30 to be produced having varying size, length and/or profile.

In one preferred embodiment of this invention, first side 32 and/or second side 33 are convex, forming an airfoil-type archery vane 10. In such an embodiment, second side 33 may be rougher than first side 34. Preferably, in this embodiment, the exposed surface area of second side 32 is greater than an exposed surface area of first side 33. For instance, FIG. 6A shows vane 30 having a plurality of microgrooves 70 extending longitudinally across second side 33 of vane 30.

Figure 8:
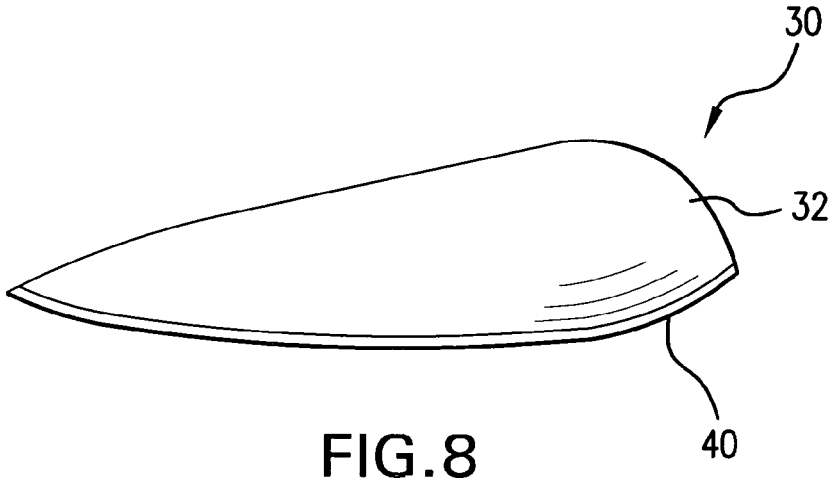
FIG. 8 is a side view of an archery vane having a bowed foot in a relaxed state according to one preferred embodiment of this invention.
Figure 9:
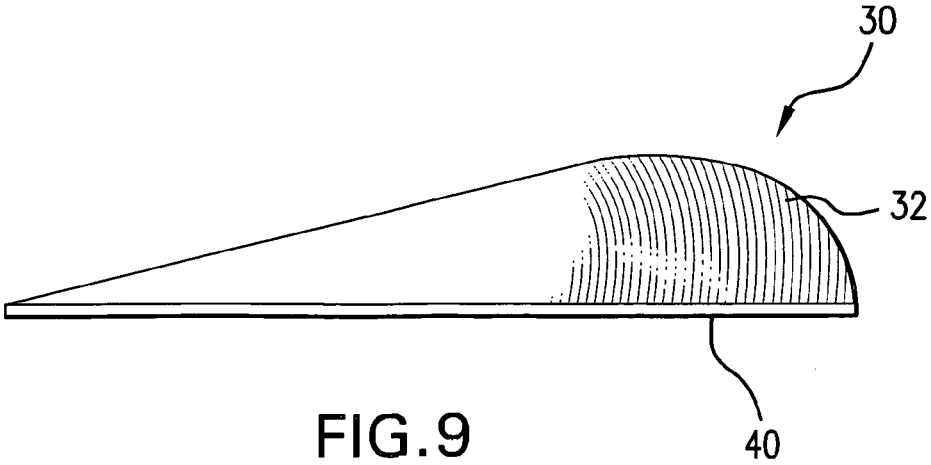
FIG. 9 is a side view of the archery vane of FIG. 8 having a concave side in a stressed state according to one preferred embodiment of this invention.

According to one preferred embodiment of this invention, vane 30 may include first side 32 and an opposite second side 33 and further include foot 40 extending along a base of vane 30 wherein, in a relaxed state, foot 40 is bowed along a lower edge. As a result of bowed configuration of foot 40 as shown in FIG. 8, when foot 40 is straightened or stressed, such as by application of vane 30 to arrow shaft 10, first side 32 (or second side 33) of vane 30 becomes concave, as shown in FIG. 9. Accordingly, vane 30 includes a generally planar side and bowed foot 40 in a relaxed state and a generally concave side and generally straight foot 40 in a stressed or tensioned state.

According to variations in the above described embodiments, first side 32 may have a first surface roughness and second side 33 may have a second surface roughness. First surface roughness and second surface roughness may be equally smooth, equally rough or have a greater or lesser surface roughness than each other. Preferably but not necessarily, first side 32 is generally planar and smooth and second side 33 is generally planer and has a second surface roughness. Preferably, but not necessarily, the second surface roughness is greater than the first surface roughness.

As a result of such concavity and/or different surface roughness and/or the bowed foot, fletching 20 according to this invention may be applied to arrow shaft 10 so that vane 30 extends parallel with a longitudinal axis of arrow shaft 10.

Figure 6B:
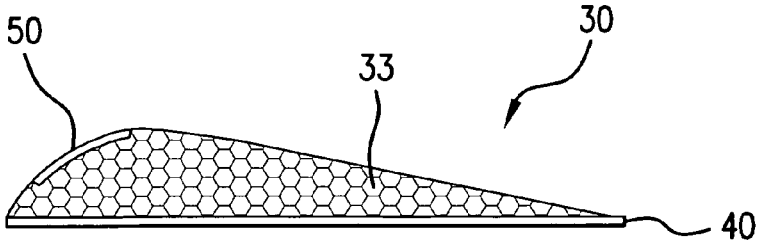
FIG. 6B is a side view of an archery vane having a plurality of irregularities forming a surface roughness according to one preferred embodiment of this invention.
Figure 6C:
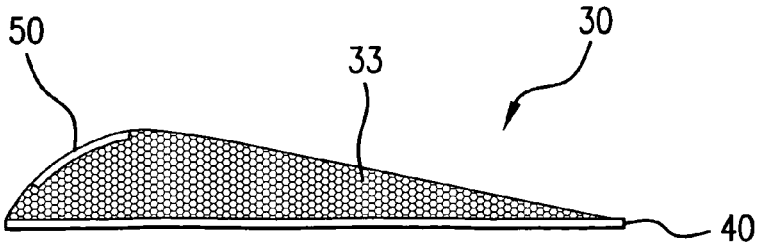
FIG. 6C is a side view of an archery vane having a plurality of irregularities forming a surface roughness according to one preferred embodiment of this invention.

As shown in FIGS. 6A, 6B and 6C, at least a portion of second side 33 has a plurality of surface irregularities that form the second surface roughness. In certain preferred embodiments of this invention, the overall pattern of the irregularities repeats in a generally consistent fashion and can be a function of desired dimensions and shapes.

The irregularities are intended to form a particular overall or average surface roughness, preferably a particular second surface roughness of second side 33. The term roughness refers to a relatively finely spaced surface texture, for example which can be a product of a particular manufacturing process or which can result from a cutting action of tools or abrasive grains. The term flaws refers to surface imperfections that occur at relatively infrequent intervals. Flaws are normally caused by nonuniformity of the material or are the result of damage to the surface subsequent to processing. Flaws typically include scratches, dents, pits and/or cracks and should not be considered irregularities that form the surface roughness contemplated by certain preferred embodiments of this invention. Roughness formed by irregularities as used in this specification and in the claims is intended to relate to a surface quality which is a product of a process and should not be confused or interchangeable with surface flaws.

In one preferred embodiment of this invention, only a portion of second side 33 comprises irregularities. In another preferred embodiment according to this invention, such as shown in FIGS. 6A, 6B and 6C, second side 33 is substantially covered with irregularities. The degree to which second side 33 is covered with irregularities may be a function of various design factors, such as the type or shape of irregularities, the material used to produce vane 30, the desired roughness of sides 32 and 33 and/or the desired rotational effect or aerodynamic effect upon the flight characteristics of the arrow.

In one preferred embodiment of this invention, the irregularities forming the second surface roughness of second side 33 comprise a plurality of adjacent lands and grooves which form microgrooves covering at least a portion of second side 33, as shown in FIGS. 5 and 6A. Preferably, the lands and grooves extend in a longitudinal direction along vane 30, such as generally parallel to each other and to longitudinal axis or spin axis of arrow shaft 10. Microgrooves range in depth from about 0.005 inch to about 0.015 inch. In another preferred embodiment of this invention, the lands and grooves are positioned at an angle with respect to each other to produce a plurality of knurls. For example, the lands and grooves can crisscross each other to form any suitably shaped apex.

In preferred embodiments of this invention, the irregularities forming the first surface roughness and the second surface roughness may vary in size and shape so long as the second totally exposed surface area of second side 33 is greater than the first totally exposed surface area of first side 32. Totally exposed surface area as used throughout this specification and in the claims is defined as the total surface area, uniform or variable, of a surface within the defined boundary including the surface area of surface irregularities that form a surface roughness.

In certain preferred embodiments of this invention, the irregularities forming the second surface roughness are formed by a process, such as but not limited to machine cutting, injection molding, and/or chemical etching, that produces pits, protuberances, pores, stippling, knurling and/or particulates that form a non-directional pattern. In still another preferred embodiment of this invention, the irregularities are formed by a process that produces a surface roughness with a multi-directional pattern. It is also possible to form irregularities with epoxy, paint or any other suitable material or process which can be used to produce the irregularities.

Regardless of the manner in which the irregularities are produced or otherwise achieved, one intended result is for the irregularities to form a surface roughness to break-up, interrupt or cause turbulence within or near a boundary layer of fluid flow passing vane 30, such as when the arrow is in flight.

Figure 7:
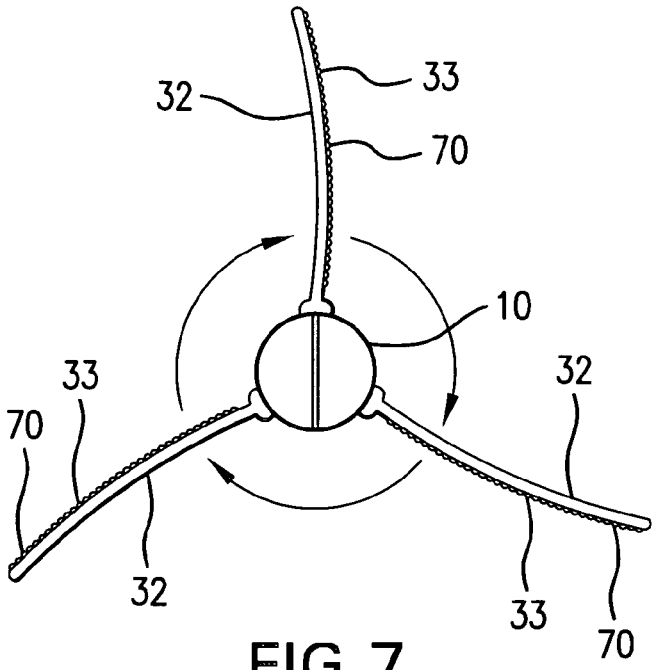
FIG. 7 is a front view of an arrow fletching having a plurality of archery vanes attached to an arrow shaft such that each archery vane is concave according to one preferred embodiment of this invention.

As shown in FIG. 7, fletching 20 comprises a plurality of vanes 30 having first side 32 having a concave configuration and the first surface roughness and second side 33 having a convex configuration and the second surface roughness, each mounted on arrow shaft 10. Second side 32 is roughened with respect to first side 33. As the arrow is in flight, the roughened second side 33 and/or convex configuration of each vane 30 disturbs or interferes with the fluid flow of air. The boundary layer of fluid is disturbed as it passes over second side 33, creating a turbulent flow that causes a lift force to act on second side 33 of each vane 30. The term lift force as used throughout this specification and in the claims refers to a force acting at a right angle to the direction of motion of arrow shaft 10 to deflect an object in a direction perpendicular to the velocity of the fluid. Preferably, arrow shaft 10 includes fletching 20 comprising three vanes 30 equally spaced around the circumference of arrow shaft 10. Therefore, the lift force exerted on second side 33 of each vane 30 by the fluid flow rotates arrow shaft 10 about spin axis 15. Arrow shaft 10 thereby rotates in a direction as shown by the arcuate arrow in FIG. 7. The angular momentum produced by the rotation provides increased rotation and increased stability of the arrow shaft and improves flight accuracy of the arrow.

The difference in roughness of second side 33 with respect to first side 32 must by optimized to produce a sufficient rotation and stability of arrow shaft 10 about spin axis 15 during arrow flight. At a rotational speed greater than optimal, the velocity of the arrow is negatively affected and the frictional drag experienced by the arrow is increased.

When kicker 50 extends outwardly from vane 30, as shown in FIGS. 1–4, the combination of kicker 50, concave first side 32 and/or the second surface roughness may increase the rotation of arrow shaft 10 about spin axis 15 and thus increases the stability of arrow shaft 10. The result is improved flight accuracy and superior aerodynamic characteristics of the arrow.

While in the foregoing specification this invention has been described in relation to certain preferred embodiments, and many details are set forth for purpose of illustration, it will be apparent to those skilled in the art that this invention is susceptible to additional embodiments and that certain of the details described in this specification and in the claims can be varied considerably without departing from the basic principles of this invention.

We claim:

1. A method of manufacturing a fletching for an archery arrow shaft comprising:

molding a flexible vane;

co-molding a kicker into a perimeter of the flexible vane; and creating tension in the flexible vane.

2. The method of claim 2 further comprising:

creating tension in the flexible vane following integration of the kicker.

3. The method of claim 2 further comprising:

co-molding the kicker from a stiffer material than the flexible vane.

4. The method of claim 2 further comprising:

attaching the flexible vane to the arrow shaft parallel to a longitudinal axis of the arrow shaft.

5. A fletching for an archery arrow shaft comprising:

a flexible vane having a generally tapered profile extending from a narrow end to a wide end; and a kicker integrated with a perimeter of the wide end of the flexible vane, the kicker having a concave portion extending tangentially from the flexible vane, wherein the kicker is integrated to place the flexible vane under tension.

6. The fletching of claim 5 wherein the kicker is molded to the flexible vane.

7. The fletching of claim 5 wherein the kicker comprises the same material as the flexible vane.

8. The fletching of claim 5 wherein the kicker comprises a different material from the flexible vane.

9. The fletching of claim 5 wherein the kicker is stiffer than the flexible vane.

10. The fletching of claim 5 wherein the flexible vane is concave.

11. The fletching of claim 5 wherein the kicker is positioned flush with the perimeter of the flexible vane.

12. The fletching of claim 5 further comprising:

a plurality of microgrooves extending longitudinally across at least one side of the flexible vane.

13. The fetching of claim 5 wherein the flexible vane extends parallel with a longitudinal axis of the arrow shaft.

14. A fletching for an archery arrow shaft comprising:

a flexible vane extending longitudinally along the arrow shaft; and a kicker molded into a perimeter of the flexible vane, the kicker formed along an arcuate path and including a concave portion extending away from the flexible vane, wherein the kicker is integrated to place the flexible vane under tension.

15. The fletching of claim 14 further comprising:

a plurality of microgrooves extending longitudinally across at least one side of the flexible vane.

16. The fletching of claim 14 wherein the flexible vane is concave.

17. The fletching of claim 14 wherein the kicker is stiffer than the flexible vane.

18. The fletching of claim 14 wherein the flexible vane extends parallel with a longitudinal axis of the arrow shaft.

19. A method of manufacturing a fletching for an archery arrow shaft comprising:

molding a flexible vane; and co-molding a kicker into a perimeter of the flexible vane, the kicker comprising a stiffer material than the flexible vane.

20. The method of claim 19 further comprising:

creating tension in the flexible vane following integration of the kicker.

21. The method of claim 19 further comprising:

positioning the kicker flush with the perimeter of the flexible vane.

* * * * *